US008056171B2

(12) United States Patent
Zambrowicz et al.

(10) Patent No.: US 8,056,171 B2
(45) Date of Patent: Nov. 15, 2011

(54) LEAK AND POOR DRAINAGE DETECTION FOR ELECTRONIC LAUNDRY MACHINE

(75) Inventors: Michael J. Zambrowicz, Ripon, WI (US); Jeffrey R. Hochtritt, Larsen, WI (US); Adam L. Kocha, Oshkosh, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 380 days.

(21) Appl. No.: 12/501,970

(22) Filed: Jul. 13, 2009

(65) Prior Publication Data

US 2010/0005597 A1 Jan. 14, 2010

Related U.S. Application Data

(60) Provisional application No. 61/080,639, filed on Jul. 14, 2008.

(51) Int. Cl.
*D06F 33/02* (2006.01)

(52) U.S. Cl. ..... 8/158; 68/12.05; 68/12.19; 68/12.21

(58) Field of Classification Search ..... 8/158; 68/12.05, 68/12.19, 12.21
See application file for complete search history.

(56) References Cited

U.S. PATENT DOCUMENTS

| | | | | |
|---|---|---|---|---|
| 4,195,500 | A | 4/1980 | Tobita et al. | |
| 5,714,939 | A * | 2/1998 | Song | 340/607 |
| 7,216,049 | B2 * | 5/2007 | Zhang et al. | 702/107 |
| 7,572,108 | B2 * | 8/2009 | Koehl | 417/53 |
| 2002/0040505 | A1 | 4/2002 | Tanaka et al. | |
| 2002/0157190 | A1 | 10/2002 | Imai et al. | |
| 2005/0125909 | A1 | 6/2005 | Bellinetto et al. | |

FOREIGN PATENT DOCUMENTS

| | | | |
|---|---|---|---|
| AU | 2005202822 | * | 1/2006 |
| JP | 03-039193 | * | 2/1991 |
| JP | 2007-111097 | * | 5/2007 |

OTHER PUBLICATIONS

European Patent Office 1 096 052 May 2001.*

* cited by examiner

*Primary Examiner* — Frankie L Stinson
(74) *Attorney, Agent, or Firm* — Leydig, Voit & Mayer, Ltd.

(57) ABSTRACT

A control system for a laundry machine provides a system and method to automatically monitor the results of the drain or pump operation during normal operation of machine cycles, during unattended idle states as well as through specific diagnostic tests. By automatically monitoring the results of the drain or pump operation, the machine controller can warn the owner or servicer of the equipment that a machine requires service attention.

15 Claims, 4 Drawing Sheets

LEAK AND POOR DRAINAGE DETECTION FOR ELECTRONIC LAUNDRY MACHINE

CROSS REFERENCE TO RELATED APPLICATION

This application claims the benefit of U.S. Provisional Application No. 61/080,639, filed Jul. 14, 2008, which is incorporated herein in its entirety.

FIELD OF THE INVENTION

The invention generally relates to laundry machines, and more particularly to a control system for a laundry machine for detecting leaks and slow drainage conditions.

BACKGROUND OF THE INVENTION

In these days of rapidly increasing urban populations and exploding resource demand in developing regions, it is ever more important to conserve our natural resources. One of our most precious resources is fresh water. Water is used in many applications, both in the home and in industry, not to mention the service sector. One important common use for water is in the washing of garments and materials, typically in a washing machine. However, an improperly maintained or adjusted washing machine is capable of wasting a great deal of water in short period of time, leading to increased costs and wasted resources.

In particular, improper operation of the drain valve or pump, can result in excessive water use during the wash cycle due to water leaking from a drain valve that is not fully closed. The improper operation of the drain valve or pump can also result in laundry cycles that require a greater period of time to complete the filling and draining process which will result in greater energy use than is necessary. The improper operation of the drain valve or pump may be due to an inherent failure of the drain valve or pump or it may be the result of a foreign object that has become lodged in the pump or drain valve.

Such foreign objects may be introduced into the machine with the laundry or may be parts of the laundry itself (fabric, zippers, bra wires, rubber backing from floor rugs, etc.). Foreign objects that may be inadvertently added with the laundry include coins, nails, screws, pencils, keys, etc. Whatever the source and exact object, the foreign object may become lodged in the valve or pump, or may otherwise result in a malfunction of the drain valve or pump which will prevent the drain valve or pump from opening or closing fully. In addition to the introduction of such foreign objects, other causes of drain or valve malfunction also exist. For example, the drain valve or pump could also malfunction as a result of normal wear and tear and the deterioration of the components of the drain valve or pump.

As a result of the above mentioned problems, the drain valve or pump may remain partially open during one or more portions of the machine cycle in which water is intended to be retained in the machine. This condition will cause water to leak from the washing machine, dramatically increasing the volume of water used by the machine. Also, the foreign object or other condition may prevent the water from draining or pumping optimally from the machine during one or more portions of the machine cycle in which the water is intended to be drained or pumped from the machine. This can cause machine cycles to take much longer and use more energy than necessary.

The above-described problems may not be easily noticed by the machine user or the owner/servicer of the equipment.

In order to determine if there is a malfunction, or if there is a foreign object lodged in the drain or pump, the owner/servicer would be required to spend considerable time and effort disconnecting power from the machine and removing the machine outer panels and drain hoses in order to examine the drain or pump to determine if it was malfunctioning.

One technique to attempt to overcome these problems involved monitoring the length of time required to fill the machine with water, or to drain water from the machine, and sounding an alarm if the time was greater than a programmed "alarm time." However, this technique is generally only useful for detecting a condition where water pressure is extremely low or non-existent resulting in the machine never reaching the desired water level. If the machine reached the desired water level prior to the alarm time, the controller accepted this without generating an error condition. Water leaks in the machine were not detected.

Similarly, the drain alarm error condition is generally only useful for detecting a nearly or completely plugged drain that results in a very long drain time or a non-draining condition. A partially obstructed drain or pump which is able to evacuate the water prior to the expiration of a drain alarm time would not be detected.

SUMMARY OF THE INVENTION

In view of the foregoing, it is an object of the invention to provide a system and method for detecting problems with the drain or pump that are not serious enough to prevent the machine cycle from running. If such problems can be detected and serviced in their early stages, this will result in significant savings of water, energy and component replacement costs.

It is a further object to provide a machine controller to automatically monitor the results of the drain or pump operation during normal operation of machine cycles, during unattended idle states as well as through specific diagnostic tests. By automatically monitoring the results of the drain or pump operation, the machine controller can warn the owner or servicer of the equipment that a machine requires service attention.

It is a further object to provide a method to apprise an owner or operator of a leak or drainage problem so that proper repair or maintenance can be performed to correct the problem.

Thus, embodiments of the invention go beyond simple monitoring for a particular present water level or rate of increase or decrease, and provide the ability to apply customized times for each machine type/size. Moreover, embodiments of the invention allow the user to alter the evaluation settings to account for actual installation site conditions. Thus, while the manufacturer may tailor the detection values to account for machine size, the user is able to adjust these values to account for actual installation conditions. With respect to leak detection (leaks into or out of machine), instead of monitoring for static water levels to detect a change, the system provides much more customization ability. For example, the operator can specify that the detection process executes only on certain days, at a certain interval or frequency, or at a particular time of day.

These objects and other related objects are achieved in various embodiments of the present invention. The features and advantages of the invention can be understood from the description of embodiments of the invention set forth below with reference to the drawings, in which:

DETAILED DESCRIPTION OF THE INVENTION

The invention provides several methods for the machine controller to automatically monitor the results of the drain or pump operation during normal operation of machine cycles, during unattended idle states as well as through specific diagnostic tests. By automatically monitoring the results of the drain or pump operation, the machine controller can warn the owner or servicer of the equipment that a machine requires service attention, or that a slow or blocked condition is imminent if not yet developed. In this way, the owner/servicer of the equipment can focus their time and energy on only the machines that have a likelihood of a problem with their drain or pump.

The invention brings the problem to the attention of the owner or servicer of the washing machine so that proper repair or maintenance can be performed to correct the problem, before an emergency situation arises in some cases. As described in the detailed descriptions below, in an embodiment of the invention, the machine controller continuously monitors the water level during the different periods of the washing machine cycle. Since the controller knows what the water level should be during different periods of the machine cycle, it can provide a warning to the owner/servicer that something is causing water to leak from the machine, or that water is not being optimally evacuated from the machine. Since the controller is able to continuously monitor the water levels automatically, the owner/servicer is not required to be present. The machine controller can record the malfunction and warn the owner/operator that service is required to repair the machine.

Figure 1:
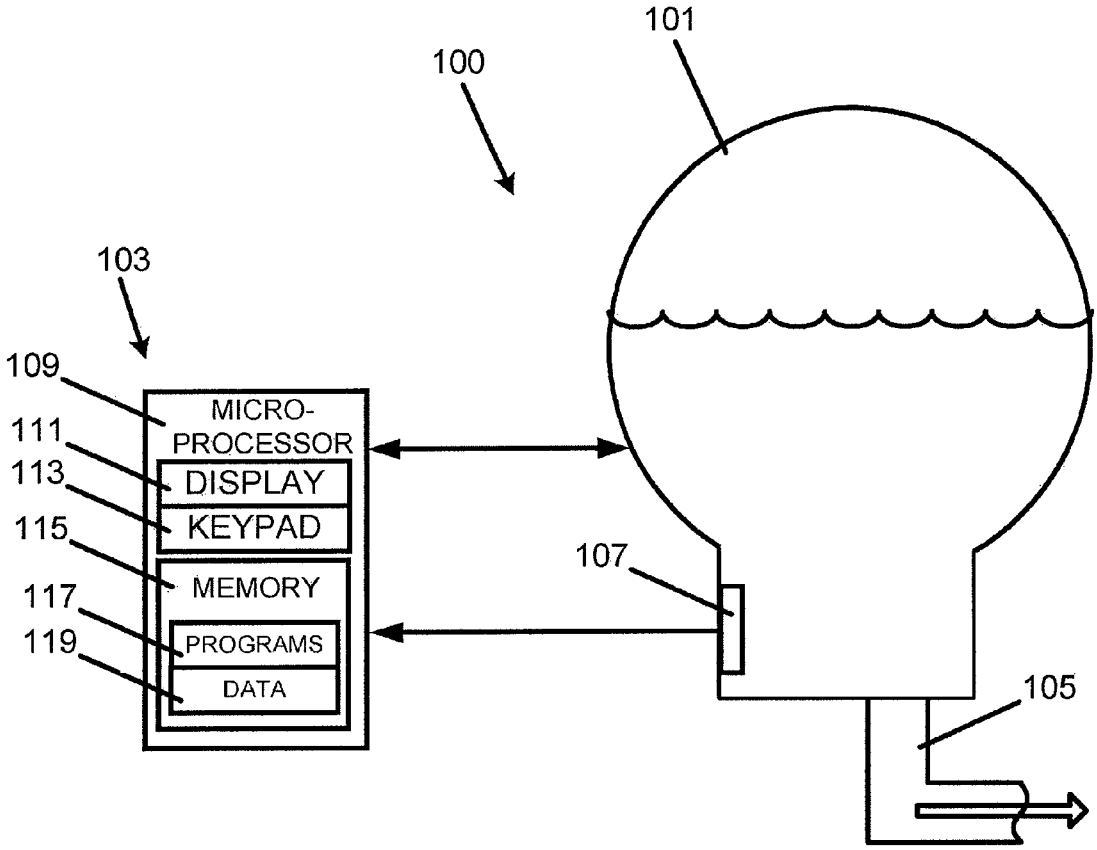
FIG. 1 is a schematic diagram showing the major components of a washing machine system within which the present invention may be implemented.

Before discussing the particular innovative methods of the invention, an exemplary environment will be discussed for the reader's convenience. FIG. 1 is a schematic diagram showing the major components of a washing machine system within which the present invention may be implemented. The system 100 includes a washing machine drum or basket 101. The motion, filing, and draining of the drum 101 are controlled by a machine controller 103, as is the agitation of the machine contents. The calibration procedures described herein are also driven by the controller 103. The machine is drained via a drain valve 105, and the water level within the drum 101 is measured via a level sensor 107.

The controller 103 includes a microprocessor 109, which supports a display 111 and keypad 113. The microprocessor 109 also contains a memory 115 for maintaining programs 117 (e.g., for ordinary running, for calibration, leak check, drain check, etc.) and data 119.

Four different methods are used by the machine controller 103 to detect a problem and warn the owner/servicer of the washing machine that there is a problem requiring them to service the machine:

1. The machine controller automatically monitors the time required for water to be drained/pumped from the machine during the Drain steps of the machine cycle. The machine controller compares the actual drain time to the values stored in a table for each machine type and size. If the drain time exceeds the accepted table value for the particular machine type/size in which the controller is installed, the controller will record an error alerting the owner/servicer of the washing machine that there is a poor drain condition and the machine's drain or pump needs to be carefully inspected.

2. The machine controller automatically monitors the water level during the periods of the machine cycle when water is intended to be retained in the machine. If the water level drops more than it should for the particular type and size machine in which the controller is installed, the controller will record an error alerting the owner/servicer of the washing machine that there is a possible water leak condition and the machine's drain or pump needs to be carefully inspected. The owner/servicer is able to program on which days of the week he wants machine cycles to monitor for this water leak condition. The owner/servicer is also able to specify that the automatic detection process occurs only after a certain number of machine cycles have been completed since monitoring last occurred.

3. The machine controller has a diagnostic test capable of testing the machine for a water leak condition. The controller will fill the machine to the Low Water Level and wait for 2 minutes monitoring any changes to the water level. The machine controller compares any drop in the water level to the values stored in a table for each machine type and size. If the drop in the water level exceeds the accepted table value for the particular machine type/size in which the controller is installed, the controller will record an error alerting the owner/servicer of the washing machine that there is a water leak condition and the machine's drain or pump needs to be carefully inspected.

The machine controller has an automatic diagnostic test capable of testing the machine for a water leak condition in an unattended situation. This test is particularly useful in checking for water leaks during unattended operation, for example during the evening hours when a Laundromat is closed for business. The owner of the equipment can program the machine controller to begin the test at a particular Hour on a particular Day(s) of the Week after a pre-programmed number of machine cycles have been completed. When all of these conditions are met, the controller will fill the machine to the Low Water Level and wait for 2 minutes monitoring any changes to the water level. The machine controller compares any drop in the water level to the values stored in a table for each machine type and size. If the drop in the water level exceeds the accepted table value for the particular machine type/size in which the controller is installed, the controller will record an error alerting the owner/servicer of the washing machine that there is a water leak condition. When the owner of the equipment is at the facility again, they can check for the error condition to see which machine drains or pumps need to be carefully inspected.

Water Leak Detection

Water leaks in the machine will cause the control to sense a water level that drops below the target water level. One of the reasons for a water leak is a drain valve/pump that is leaking due to malfunction of the drain valve/pump or due to a foreign object jammed in the drain valve/pump. A water level that drops below the target level can also be caused by a very absorbent load of garments that soaks up the water during the agitation action of the machine. An over-suds condition can also affect the water level sensing of the control. If there is an over-suds condition in the machine, the water level may look like it has dropped below the target water level.

Whenever the control is in an Agitate cycle step, and if it senses that the water level has fallen to 90% or less of the programmed target water level value, the control will turn the required water valves back on and execute a refill until the target water level has been reached again.

Water Leak Detection During a Machine Cycle

The Water Leak Detection During A Machine-Cycle parameter is programmable On or Off. The factory-default is set to Off. The Water Leak Detection During A Machine Cycle Active Day-of-Week parameter may be programmed from 0 (no active Day-of-Week) to 127 (active every Day-of-Week). The factory-default value is set to 0. The Water Leak Detection During A Machine Cycle Number of Cycles parameter may be programmed from 0 (no cycles required) to 127 (127 cycles required). The factory-default value is set to 0. If the Water Leak Detection During A Machine Cycle is programmed to ON, and if the current Day-of-Week is enabled in the Water Leak Detection During A Machine Cycle Active Day-of-Week parameter and if the number of cycles which have occurred since the last water leak detection during a cycle meets the programmed value in the Water Leak Detection During a Machine Cycle Number of Cycles program parameter, when the machine cycle reaches the last Drain step at the end of the machine cycle, the control will pause the machine cycle. The control will record the current water level from the electronic water level sensing input and continue to monitor the water level in the system for a period of time (ninety seconds for example). After the time period has expired, the control will compare the ending water level with the level at the start of the monitoring period. If the water level has dropped more than an acceptable amount, the control will save a water leak error status and will continue the machine cycle. When finished checking for a water leak, the control will open the Drain (or turn on the pump if a pump-equipped machine), and will continue the machine cycle to the end.

When the cycle has been completed and if the control had saved a water leak error status, the control will display an error message and will record the event in the error audit data. This error result can be a useful indication to the machine owner that there could be a problem with his drain or pump. The machine owner can then utilize the next test, the Water Leak Diagnostic Test, to determine if there is actually a problem with his drain valve or pump.

If the Water Leak Detection Error occurs during a machine cycle as described above, the control will record the error and display an error message. The control saves the error type, cycle, segment and step in which it happened, as well as the date and the time to a queue holding the last eight (8) machine errors.

Water Leak Detection During A Machine Cycle (on/off) Program Parameter:

Range: 0 (disabled)
1 (enabled)

Default: 0 (disabled)

Water Leak Detection During A Machine Cycle Active Day-of-Week Program Parameter Range: (0-127: -,S,F,R,W,T,M,S)

Default: 0 (no days enabled)

Water Leak Detection During A Machine Cycle Number of Cycles Program Parameter

Range: (0-127)

Default: 0 (nomachine cycles)

Water Leak Detection Diagnostic Test

This test may be started both manually and by a communication command. When the test is started, the control will prompt for the user to press the START keypad to begin the operation. When the START keypad is pressed, the control will lock the door. When the control sees that the door has been locked it will close the drain valve or keep the pump off, turn the Available output off (unavailable), turn the Cold Water Valve on and ignore all user input until the end of the end of the test. Once the Low water level is reached, the control will turn off the Cold water valve and wait for ten (10) seconds for the water pressure to stabilize. After this delay, the control will record the current water level from the electronic water level sensing input and continue to monitor the water level in the system for two (2) minutes.

After the two (2) minutes have expired, the control will compare the ending water level with the level at the start of the two (2) minute monitoring period. If the water level has dropped more than an acceptable amount, the control will display "FAIL" and will record a Water Leak Detection Error in the audit data. If the water level has not dropped more than the acceptable amount, the control will display "PASS". In both cases, the control will open the Drain (or turn on the pump if a pump-equipped machine). When the water has been drained (or pumped) out of the machine, the control will unlock the door. If the result had been "PASS" the control will return to Ready Mode. If the result had been "FAIL", the control will display the error message. There is a non-programmable data table stored in the control which contains for each machine size/type an acceptable water level drop. If the control senses a drop in water level greater than the amount specified for this machine size and type, the control will fail the Water Leak Detect as described above. The error message is an indication to the machine owner that there should be service attention devoted to the drain valve (or pump) on this machine to see if this is where the water leak is originating.

If the Water Leak Detection Error occurs during the Water Leak Detection Diagnostic Test as described above, the control will record the error and display an error message. When the diagnostic test is completed, and after displaying "FAIL" during the test, the control will display an error message until the machine is powered down. The control saves the error type, the date and the time to a queue holding the last eight (8) machine errors. No cycle, step or segment information is saved (since it was not running a cycle).

Auto-Water Leak Detection

If enabled, the programmable Auto-Leak Detection Option allows the control to be set to automatically check for water leaks at predetermined intervals and times. The option may be enabled or disabled (factory default is disabled). If enabled, and the machine is in Ready Mode with the door closed, and the pre-programmed number of cycles have occurred since the last Auto-Water Leak Detect, and the current day-of-week matches the programmed day-of-week, and the current hour matches the programmed hour, then the control will close the drain valve and turn on the Cold water valve until the global Low Water Level is reached. The operation is the same as defined in the first paragraph of Section above.

After the two (2) minutes have expired, the control will compare the ending water level with the level at the start of the two (2) minute monitoring period. If the water level has dropped more than an acceptable amount, the control will display "FAIL" and will record a Water Leak Detection Error in the audit data. If the water level has not dropped more than the acceptable amount, the control will display "PASS". In both cases, the control will open the Drain (or turn on the pump if a pump-equipped machine). When the water has been drained (or pumped out) out of the machine, the control will unlock the door and return to Ready Mode. There is a non-programmable data table stored in the control which contains for each machine size/type an acceptable water level drop. If the control senses a drop in water level greater than the amount specified for this machine size and type, the control will fail the Water Leak Detect as described above. In the case of a failure, the machine owner can monitor the audit data. If the audit data indicates a failure occurred on a machine, the owner can devote service attention to the drain valve (or pump) on this machine to see if this is where the water leak is originating.

If the Water Leak Detection Error occurs during the Auto Water Leak Detection as described above, the control will record the error and display an error message. When the Automatic test is completed, and after displaying "FAIL" during the test, the control will display an error message. The control will then return to Ready Mode. The control saves the error type, the date and the time to a queue holding the last eight (8) machine errors. No cycle, step or segment information is saved (since it was not running a cycle).

Auto-Water Leak Detection Option Program Parameter Disable(0)/enable(1)

default: 0 (disabled)

Number of cycles between Auto-Water Leak Detection(0-127) Default: 10

Auto-Water Leak Detection Hour Program Parameter Range: (0-23)

Default: 0

Auto-Water Leak Detection Day-of-Week Program Parameter Range: (0-127: -,S,F,R,W,T,M,S)

Default: 127(every day enabled)

In an embodiment of the invention, the controller provides an owner-programmable input variable that allows the equipment owner or manager to restrict the leak detection so that it will not occur for every machine cycle. In this embodiment of the invention, the owner can program the leak detection to occur during machine cycles only on certain days of the week, between certain hours of the day and/or only after a set number of machine cycles have occurred since the last time the leak detection was performed. Moreover, since the leak detection process necessarily adds a certain amount of time to the running machine cycle time, and since it may sometimes be desirable to prevent all customer cycles from being lengthened, the owner or manager can select for the leak detection to occur, for example, only on a day of the week and time period when his laundromat is not busy (i.e.: Tuesday morning from 6-7 am.).

In a further embodiment of the invention, the controller monitors not only for a water leak from the drain valve, but also monitors for Fill Water Valve problems, e.g., an increasing water level which is indicative of a Fill Water Valve which is failing and is stuck open and allowing water to continue filling after it should have stopped. This condition can occur due to a mechanical failure of the water fill valve or the presence of a foreign body (calcium, rust, etc) in the water input which can force the valve to stick open and thus waste water since the water never completely shuts off. This feature is executed in essentially the same manner as the leak detection process (i.e., detecting a leak out of the machine), with an increased water level rather than a decreased water level being indicative of a leaking/stuck valve.

Slow Drain Detection

Poor drain conditions will cause the control to sense a longer than normal period of time for the water level to drop below the empty level. There may be several reasons for this slower than normal draining: a drain valve malfunction, a foreign object jammed in the drain valve, or a poor drain connection between the machine drain and the building sewer system. An over-suds condition may also affect the drain and lead to a slow drain condition.

Whenever the control is in a Drain cycle step, the control keeps track of the time required for the water level to fall below the Empty Level. There is a non-programmable data table stored in the control which contains for each machine size/type an acceptable time period for this drain. If the control senses a drain time greater than the amount specified for this machine size and type, the control will generate a Slow Drain Error, if enabled. The error message is an indication to the machine owner that there should be service attention devoted to the drain valve or connections to the building drain for this machine to see if this is where the slow drain condition is originating.

If the Slow Drain Error occurs during a machine cycle as described above, the control will record the error and display an error message. When the machine cycle is completed, and after the End-of-Cycle Mode is exited by opening the door, the control will display an error message. The control saves the error type, cycle, segment and step in which it happened, as well as the date and the time to a queue holding the last eight (8) machine errors.

Slow Drain Detection (on/off) Program Parameter

Range: 0 (disabled) 1 (enabled) Default: 0 (disabled)

Figure 2:
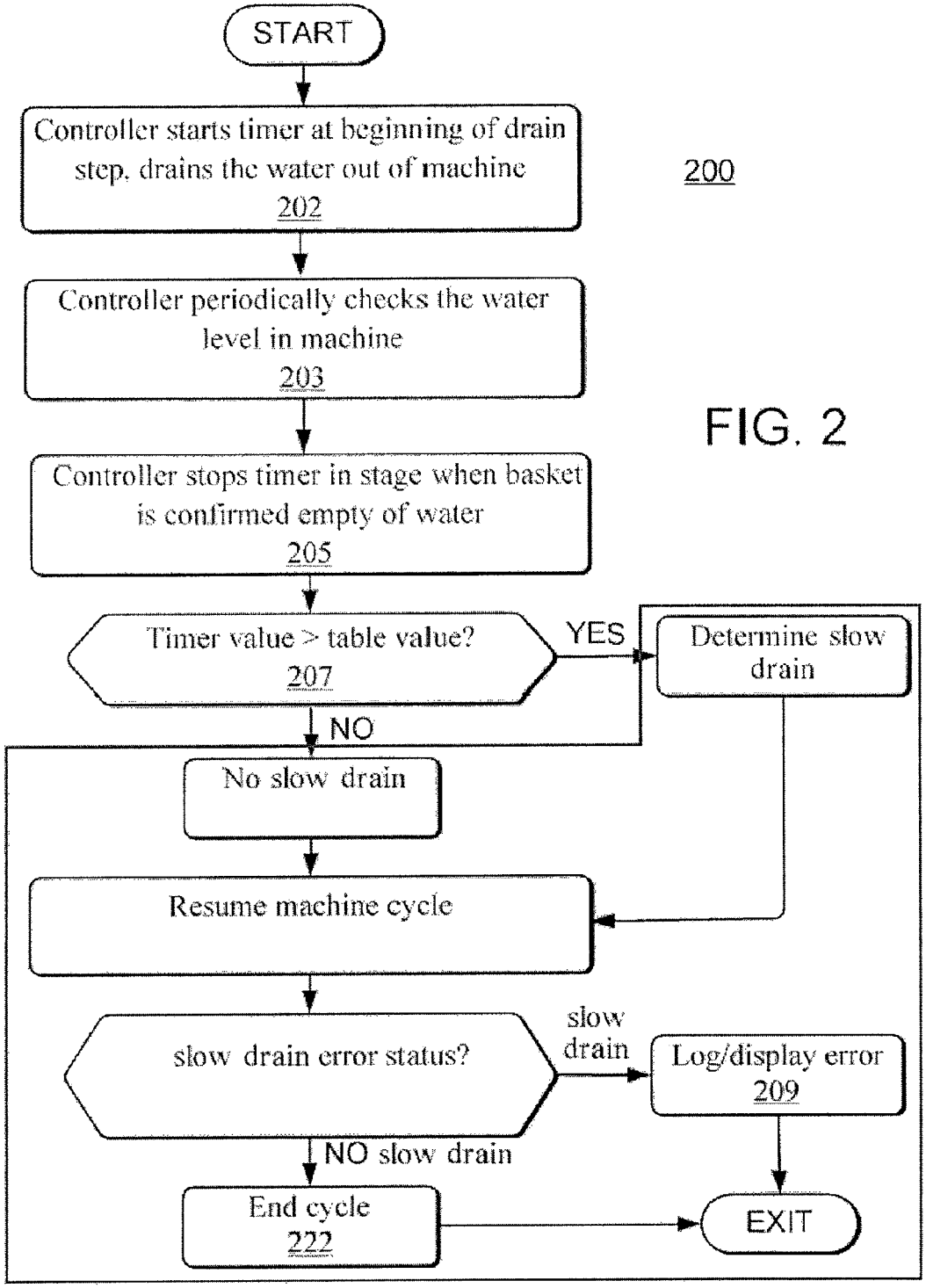
FIG. 2 is a flowchart showing a process for detecting a slow drain condition according to an embodiment of the invention.

FIG. 2 is a flowchart showing a process for detecting a slow drain condition. At stage 201 of the process 200, the controller starts a timer at the beginning of the drain step and drains the water out of the machine. While the machine is draining, the controller periodically checks the water level in machine 203, and stops the timer in stage 205 when the basket is confirmed to be empty of water. At this point, the Timer value is compared to a table value for the machine size at stage 207, and if value is greater than the table value then the controller sets an error status, to be logged ay stage 209 and displayed at the end of the cycle. Otherwise, the cycle the cycle proceeds without error. In either case, the cycle ends at stage 222.

Figure 3:
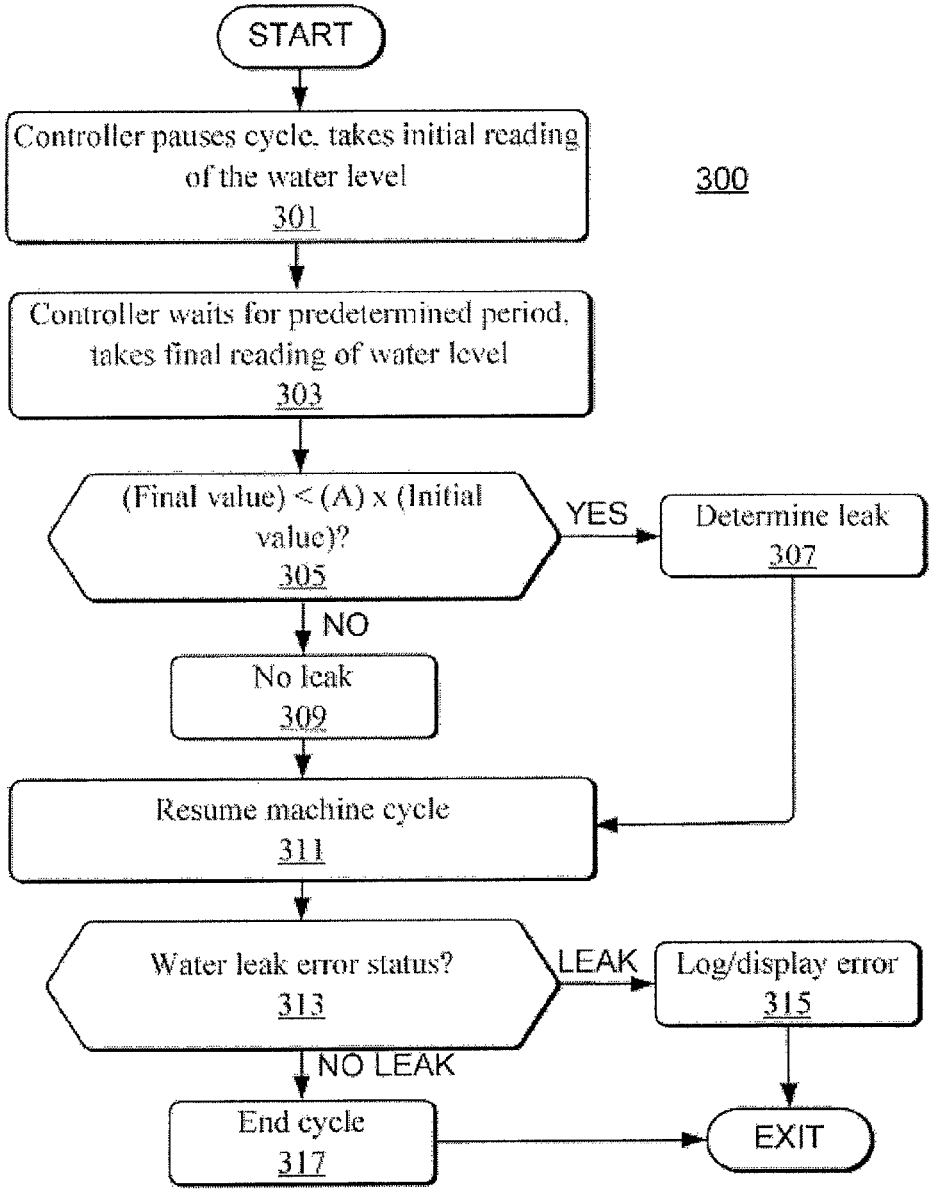
FIG. 3 is a flowchart showing a process for detecting a leaky drain during a cycle according to an embodiment of the invention.

FIG. 3 is a flowchart showing a process for detecting a leaky drain during a cycle. As an initial condition, the machine is running a cycle, has finished agitating and is ready to drain the water at the end of the cycle. At stage 301 of process 300, the controller pauses the cycle, and takes an initial reading of the water level and saves this value. At stage 303, the controller waits for a time period (for example 60 or 90 seconds) and takes a final reading of the water level and compares this value in stage 305 to the initial value. If the final value has dropped more than a specified value from a table for the particular machine size, the controller determines there is a water leak at stage 307 and saves this error status. Otherwise, the controller determines there is not a water leak at stage 309 and resumes the machine cycle at stage 311 and allows it to run to completion.

When the cycle ends, the control checks at stage 313 to see if a water leak error status was saved as described above. If a water leak error status was saved, the control will log and display an error at stage 315. Otherwise, the controller will just end the cycle normally at stage 317.

Figure 4:
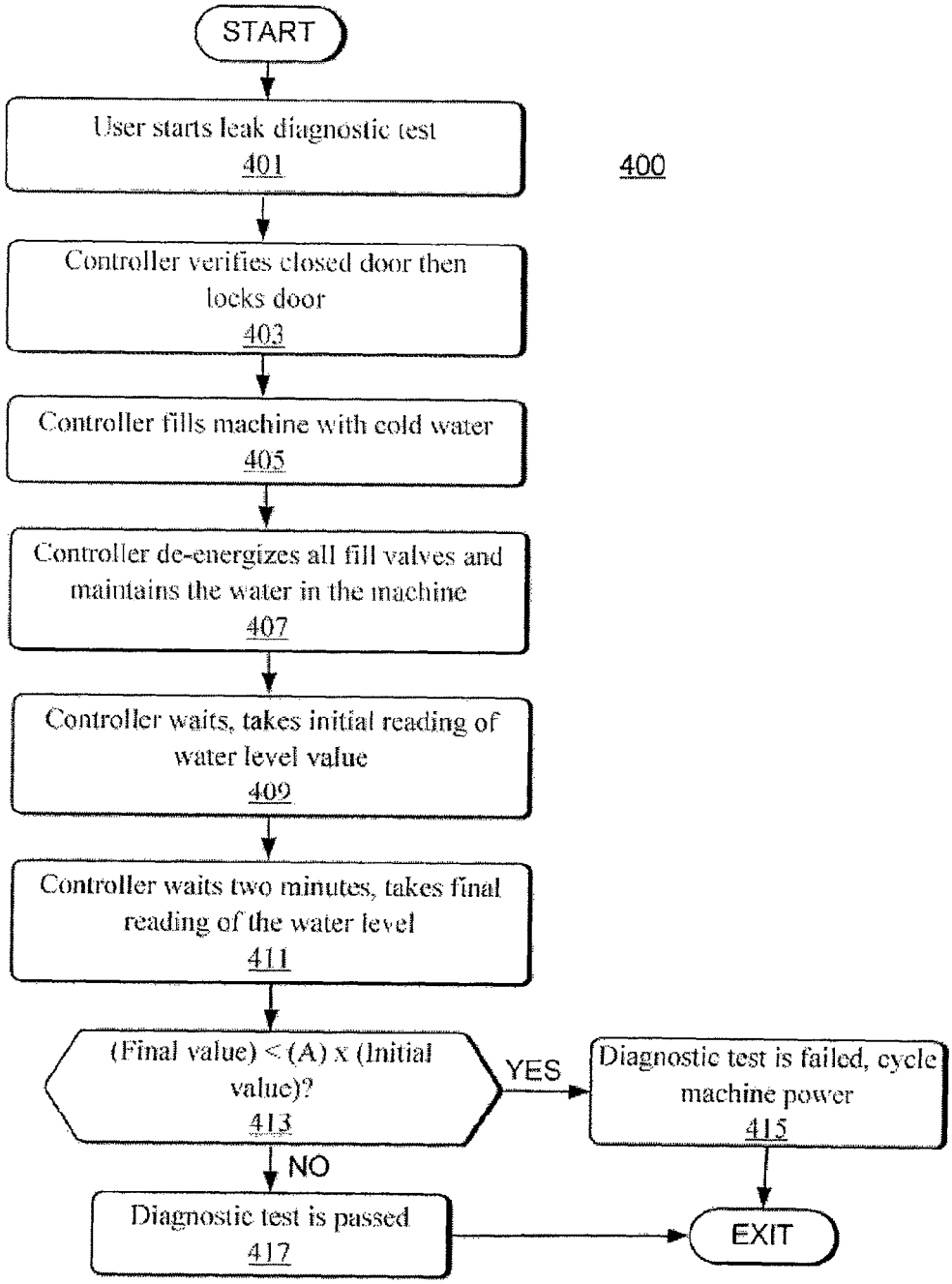
FIG. 4 is a flowchart showing execution of a leak diagnostic test according to an embodiment of the invention.

In addition to the tests run during operation, a user may also require a leak diagnostic test as illustrated by the process of FIG. 4. The user starts leak diagnostic test at stage 401 of process 400. The controller verifies closed door and then locks the door at stage 403, and fills the machine with cold water at stage 405. Once at level, the controller de-energizes all fill valves and maintains the water in the machine at stage 407. The controller then waits, for example, for ten seconds then takes and saves an initial reading of the water level value at stage 409.

The controller then waits two minutes in stage 411 and takes a final reading of the water level and compares this value to the initial value at stage 413. If the final value has dropped more than a specified value from a table for the particular machine size, the diagnostic test is considered failed at stage 415 and the user must cycle power to inspect the machine. Otherwise, the diagnostic test is considered passed at stage 417 and the user may continue to use the machine.

In an embodiment of the invention, an auto-leak diagnostic test is provided. This test is the same as the leak diagnostic test described above, but rather than a user starting the test, the test may be scheduled to automatically activate at a particular time, on a particular day or days of the week, and after a programmed number of machine cycles have occurred since the last time this test was run automatically. This allows the owner of the equipment to restrict the testing to occur only on machines that have experienced a certain amount of usage as well as to have the test run automatically during idle time periods.

According to this embodiment, the user programs the control for a day or days of the week when the test should be allowed to occur and the time of day when the test may be allowed to start. The user also programs the control for the number of completed machine cycles which must occur for the test to be able to be run automatically. When the user-specified criteria are met, and if the machine door is closed and the machine is idle, the control will automatically start the leak diagnostic test which is described above in conjunction with FIG. 4.

In an embodiment of the invention, a user-programmable variable input is exposed via the user interface, so that the user can set this variable value via a push button, slider, etc. In this embodiment of the invention, the system is shipped from the manufacturer with a value of zero, but can be increased by the equipment owner to account for a variation between the actual drain plumbing conditions at the installation site and the more ideal drainage conditions to which the system was initially calibrated. This will help avoid nuisance warnings regarding a seemingly poor drain condition that is actually a reflection of a stable installation site plumbing condition. Thus, for example, if the site plumbing from the machine drain to the sewer connection is not ideal, but is stable, the site manager can increase the Slow Drain Adjust value (e.g., by 0-255 seconds) to provide additional tolerance to allow for the extra time needed to drain the machine under the real-world installation.

In a further embodiment of the invention, the control is programmed to run an initial installation site calibration procedure to determine the initial plumbing situation for the machine. This calibration feature may be automatic or user-initiated, and may occur at the first use upon installation, or may occur after a predetermined number of uses, or upon demand. In this way, the control measures the initial plumbing situation (i.e., drainage time) of the machine as installed, and makes future decisions based on this calibration. In a further embodiment of the invention, the automatic calibration is implemented by the controller automatically setting of the Slow Drain Adjust Value based on the calibration test.

In view of the many possible embodiments to which the principles of this invention may be applied, it should be recognized that the embodiment described herein with respect to the drawing Figures is meant to be illustrative only and should not be taken as limiting the scope of invention. Those of skill in the art will recognize that the elements of the illustrated embodiments can be modified in arrangement and detail without departing from the spirit of the invention. Therefore, the invention as described herein contemplates all such embodiments as may come within the scope of the following claims and equivalents thereof.

We claim:

1. A method of checking a laundry machine for a slow drain condition, wherein the machine has a controller and memory, the method comprising:

determining a type of the machine, wherein each machine type is associated with a machine capacity;

setting a slow drain limit time in the memory of the machine in keeping with the determined machine type;

via the machine controller, performing steps including:

starting a drain step and starting a timer at the beginning of the drain step to drain water out of the machine;

while the machine is draining, periodically checking the water level in the machine;

stopping the timer in stage when the machine is empty of water;

comparing the timer value to the slow drain limit time; and if the timer value is greater than the slow drain limit time then logging an error, and otherwise, allowing the cycle to proceed without logging an error.

2. The method of checking a laundry machine for a slow drain condition as described in claim 1, wherein the controller displays information to the machine user via a machine display.

3. The method of checking a laundry machine for a slow drain condition as described in claim 1, wherein the machine display includes or is associated with a user input mechanism.

4. The method of checking a laundry machine for a slow drain condition as described in claim 3, wherein the user mechanism is adapted to accept a user-adjustable time variance value, whereby a user may select the time variance value to increase the slow drain limit time by a desired amount.

5. The method of checking a laundry machine for a slow drain condition as described in claim 1, further comprising:

running a calibration check after installation of the machine at an installation site, wherein the calibration check includes determining the amount of time required for the machine to drain as installed; and adjusting the slow drain limit time based on the results of the calibration check.

6. The method of checking a laundry machine for a slow drain condition as described in claim 5, wherein running a calibration check after installation of the machine at an installation site includes running the calibration check during the first use of the machine at the installation site.

7. The method of checking a laundry machine for a slow drain condition as described in claim 5, wherein running a calibration check after installation of the machine at an installation site includes running the calibration check after a predetermined number of cycles of the machine at the installation site.

8. The method of checking a laundry machine for a slow drain condition as described in claim 5, wherein running a calibration check after installation of the machine at an installation site includes running the calibration check after a user-determined number of cycles of the machine at the installation site.

9. A method of checking a laundry machine for a leak condition after the machine has finished agitating and is ready to drain the water at the end of the cycle, wherein the machine has a controller and memory, the method comprising:

determining a type of the machine, wherein each machine type is associated with a machine capacity;

setting a level drop limit in the memory of the machine in keeping with the determined machine type;

via the machine controller, performing steps including:

pausing the cycle and taking an initial reading of the water level and saving this initial value;

waiting for a time period and taking a final reading of the water level;

comparing this value to the initial value; and if the final value has dropped more than the level drop limit, declaring a water leak and saving an error status, and otherwise, resuming the machine cycle without declaring a water leak.

10. The method of checking a laundry machine for a leak condition according to claim 9, wherein the controller displays information to the machine user via a machine display and wherein the machine display includes or is associated with a user input mechanism.

11. The method of checking a laundry machine for a leak condition according to claim 10, wherein the user mechanism is adapted to accept a user-selectable activation value, whereby a user may select the activation value to dictate when the check for leak condition is executed.

12. The method of checking a laundry machine for a leak condition according to claim 11, wherein the activation value includes at least one of a day of week value, a time of day value, a time window value defining one or more permissible time of day windows during which to run the check for leak condition, and an interval value defining the number of machine cycles between checks for leak conditions.

13. A method of checking a laundry machine for a fill leak condition after the machine has finished agitating and is ready to drain the water at the end of the cycle, wherein the machine has a controller and memory, the method comprising:

determining a type of the machine, wherein each machine type is associated with a machine capacity;

setting a level rise limit in the memory of the machine in keeping with the determined machine type;

via the machine controller, performing steps including:

pausing the cycle and taking an initial reading of the water level and saving this initial value;

waiting for a time period and taking a final reading of the water level;

comparing this value to the initial value; and if the final value has increased more than the level rise limit, declaring a water fill leak and saving an error status, and otherwise, resuming the machine cycle without declaring a water leak.

14. The method of checking a laundry machine for a fill leak condition according to the method described in claim 13, wherein the controller displays information to the machine user via a machine display and wherein the machine display includes or is associated with a user input mechanism.

15. The method of checking a laundry machine for a fill leak condition according to the method described in claim 14, wherein the user mechanism is adapted to accept a user-selectable activation value, whereby a user may select the activation value to dictate when the check for leak condition is executed, and wherein the activation value includes at least one of a day of week value, a time of day value, a time window value defining one or more permissible time of day windows, and an interval value defining the number of machine cycles between checks for fill leak conditions.

* * * * *